US005813326A

United States Patent [19]

Salomon

[11] Patent Number: 5,813,326

[45] **Date of Patent: *Sep. 29, 1998**

[54] MAILING MACHINE UTILIZING INK JET PRINTER

[75] Inventor: James A. Salomon, Cheshire, Conn.

[73] Assignee: Pitney Bowes Inc., Stamford, Conn.

[ * ] Notice: The term of this patent shall not extend beyond the expiration date of Pat. No. 5,467,709.

[21] Appl. No.: 515,771

[22] Filed: Aug. 16, 1995

Related U.S. Application Data

[63] Continuation of Ser. No. 362,330, Dec. 22, 1994, Pat. No. 5,467,709.

[51] Int. Cl.[6] ..... B41J 11/00; B41J 1/00

[52] U.S. Cl. ..... 101/93; 101/92; 347/4; 347/104

[58] Field of Search ..... 101/91, 92, 93; 347/4, 104, 105; 346/135.1, 136; 400/584, 585

[56] References Cited

U.S. PATENT DOCUMENTS

| | | | |
|---|---|---|---|
| 3,791,293 | 2/1974 | Rastorguyeff et al. | 101/92 |
| 4,122,457 | 10/1978 | Erikson et al. | 347/4 |
| 4,278,018 | 7/1981 | Johannesson | 101/93 |
| 4,370,665 | 1/1983 | Scranton et al. | 347/104 |
| 4,492,161 | 1/1985 | Johnson et al. | 101/93 |
| 5,038,153 | 8/1991 | Liechti et al. | 347/4 |
| 5,255,020 | 10/1993 | Martin et al. | 347/4 |

*Primary Examiner*—Christopher A. Bennett
*Attorney, Agent, or Firm*—Steven J. Shapiro; Melvin J. Scolnick

[57] ABSTRACT

A mailing machine is disclosed in which a digital printing device, preferably of the ink jet type, is mounted for movement between one of two printing positions, in one of which the printing device will print a postage indicia direction on envelopes being fed through the mailing machine, and in the other of which the printing device prints the postage indicia on a strip of tape which is extracted from the mailing machine and affixed to an envelope which is incapable of being fed through the mailing machine. There is also a third position for the printing device which is a maintenance position to which the printing device is moved after each or some other predetermined number of printing cycles for the purpose of cleaning the ink ejecting portion of the printing device and/or maintaining a suitable high ink solvent vapor atmosphere adjacent to the ink ejecting portion of the printing device.

14 Claims, 4 Drawing Sheets

MAILING MACHINE UTILIZING INK JET PRINTER

This is a continuation of application Ser. No. 08/362,330 filed Dec. 22, 1994, now U.S. Pat. No. 5,467,709.

BACKGROUND OF THE INVENTION

The present invention relates generally to the field of mailing machine, and more particularly to mailing machines incorporating postage meters having an ink jet printer for printing postage indicia on mail pieces.

Mailing machines for printing postage indicia on envelopes and other forms of mail pieces have long been well known and have enjoyed considerable commercial success, both in the U.S. Postal Service and in industry mail rooms and private office environments. Generally speaking, there are many different types of mailing machines, ranging from relatively small units which handle only one mail piece at a time to large, multi-functional units which can separate, feed, weigh, print postage indicia on and stack hundreds of mail pieces per hour in a continuous stream operation. Thus, the modern mailing machine plays an important role in facilitating the rapid and efficient movement and other handling of mail.

Mailing machines have traditionally been capable of printing postage indicia either directly on mail pieces, or on pieces of tape, which are then attached to mail pieces. Typically, the mailing machine is set to print the postage indicia on envelopes as they are fed seriatim along a feed deck by a suitable feeding mechanism, the printing operation being carried out by a printing device which is part of a postage meter component of the mailing machine. The postage meter component has various control devices by which it can be set to print a predetermined amount of postage, together with other settable information, such as a date, within a pre-set design, the selectable information and the pre-set design all constituting the aforementioned postage indicia.

In traditional mailing machines, the printing device of the postage meter consists of a printing die having a surface which is embossed in the image pattern of the postage indicia, an inking device which applies ink to the image surface of the printing die, and a suitable means for bring the appropriate surface of the mail piece into contact with the printing die so as to transfer ink from the die to the surface of the mail piece. Typically, there are two forms of postage meter printing devices, the rotary, in which the printing die is curved and is mounted on a rotating drum, and the image receiving surface of the envelope is brought into contact with the printing die by feeding the mail piece between the printing die and back up roller which constitutes part of the feeding mechanism of the mailing machine. The other form of printing device, the flat bed, utilizes a flat, stationary printing die, and the mail piece is fed to an appropriate position over the platen and is momentarily stopped in that position while the platen assembly moves to press the image receiving surface of the mail piece against the printing die.

Regardless of which type of printing device is utilized in the postage meter, it is often necessary to print the postage indicia on a strip of tape, either gummed or adhesive backed, because it is not possible to feed the mail piece on which it is desired to apply a postage indicia through the mailing machine. In many situations, for example, the mail piece may be too thick to be fed through the normal feeding path of the mailing machine, or it may be too large in area, or it may contain delicate material which could be damaged by the pressure exerted by the printing device of the postage meter. For whatever, reason, there are numerous occasions in the normal operating situations of a mailing machine, where the postage indicia simply cannot be applied direction to the mail piece and must be applied to a strip of tape which is then suitably adhered to the mail piece.

In typically heretofore known mailing machines, there is only one printing position in the mailing machine, which is where the printing die is located. The printing device is in a fixed position relative to the mailing machine, regardless of whether the printing device is of the rotary or flat bed type, that position being determined either by the arcuate path of movement of the rotary printing die or the fixed position of the flat bed printing die. Since the position of the printing die in the printing device determines the printing position, it is therefore necessary to move either the mail piece or the strip of tape to the printing position for printing a postage indicia thereon. This presents no problem with respect to printing postage indicia on mail pieces because the architecture of the mailing machine is typically built around the movement of mail pieces through the mailing machine.

The problem that arises with traditional mailing machines is that when it is desired to print the postage indicia on a piece of tape rather than directly on a mail piece, it is necessary to move the tape from a standby position to a printing position within the mailing machine. Typically, the tape is stored in the form of a large roll, and a feeding mechanism is provided to feed an appropriate length of tape to accept the postage indicia. However, in order to print the postage indicia on the tape, the portion thereof on which printing is to take place must be moved, usually laterally of the direction of feed of the tape, from a standby position in which tape is disposed out of the normal feed path of mail pieces moving through the mailing machine, to a printing position in which the portion of the tape on which the indicia is to be printed is disposed in the normal feeding path of the mail pieces, so that portion of the tape is now in the printing position of the postage meter printing device.

It should be apparent from the foregoing that considerably complex mechanical structure for guiding the tape along its feed path and through the printing position in the case of a rotary printing device, or for holding the tape securely in a fixed position in the case of a flat bed printing device, coupled with necessary electrical controls, are all required to move a predetermined section of tape from the standby position to the printing position. The complexity of this structure is further complicated by the fact that only an intermediary portion of the tape on which printing takes place is moved laterally, since the storage roll and input feeding devices cannot be shifted, nor can the output feeding devices, a severing device and the ejection station from which the printed and severed piece of tape is retrieved by the operator. The complexity of this structure greatly increases the cost of mailing machines that print postage indicia either on mail pieces or on tape, and also increases the likelihood of breakdowns and service calls. These factors can be decisive to a customer in the selection of a mailing machine with or without the capability of printing postage indicia on tape.

Thus, it should be apparent that a mailing machine which has the capability of printing postage indicia on tape as well as directly on mail pieces without the necessity of moving the tape laterally from a standby position to a printing position would have considerable commercial advantage over currently available mailing machines in which this lateral movement of the tape is inherent, and would represent a major advancement in future mailing machine design.

SUMMARY OF THE INVENTION

The present invention greatly alleviates, if not entirely eliminates, the foregoing as well as other problems and disadvantages of currently available mailing machines, and does so in a highly effective and cost advantageous manner.

It has long been well known in the field of digital printing, that it is possible to move a digital printing device, either while it is printing for the purpose of creating an image, or after completion of printing for the purpose of moving it from a printing position to a storage or maintenance position. In this regard, it should be noted that there are a variety of printing apparatus commercially available in which a printing device, such as an ink jet ink jet printer, is moved across a piece of paper, which is indexed longitudinally at the completion of each line of print, and is moved beyond the normal range of printing movement when printing is completed to disposed the printing device in the maintenance position.

The present invention incorporates an ink jet printing device, such as a bubble jet, Piezo liquid ink or Pikezo hot melt ink, into a mailing machine, and utilizes the principles of movement of the printing device between a printing position and a storage position, but additionally provides a second printing position, whether alone or intermediate the primary printing position and the storage position, at which printing can take place on a different medium from that on which printing takes place at the primary printing position. Thus, it become possible to provide at least two different printing positions, a first at which printing takes place on a primary medium, e.g., mail pieces that are fed into and through the mailing machine, and a second at which printing takes place on a secondary medium, e.g., a strip of tape that is fed through a tape feeding device in the mailing machine.

With this in mind, the present invention, in its broader aspects, is a mailing machine for printing postage indicia on mail pieces which are fed through the mailing machine or on a predetermined lengths of tape which is stored in the mailing machine. The mailing machine comprises means defining a first elongate feed path which extends through the mailing machine and along which mail pieces are adapted to be fed, means defining a first printing position in the first feed path at which a postage indicia is printed on the mail pieces, and first feeding means for feeding the mail pieces seriatim along the first feed path and past the first printing position. There are means defining a second elongate feed path which extends through a portion of the mailing machine and along which a strip of tape stored in the mailing machine is adapted to be fed, means defining a second printing position in the second feed path at which a postage indicia is printed on a predetermined length of the tape, and second feeding means for feeding the tape along the second feed path and past the second printing position. There is a printing device for printing the postage indicia on the mail pieces and on the tape, means mounting the printing device for movement in a direction lateral to the direction of the first and second feed paths so that the printing device can be disposed at either of the first or second printing positions, and means for moving the printing device in said lateral direction. Finally, there is a control means for controlling the operation of the moving means for moving the printing device between the first and second printing positions depending on whether the postage indicia is to be printed on mail pieces fed along the first feed path or on tape fed along the second feed path whereby postage indicia can be printed on mail pieces or on tape selectively while the mail pieces or the tape move in their respective feed paths.

In some of its more limited aspects, the means defining the first and second elongate feed paths are spaced closely adjacent to one another so that they are disposed in adjacent closely spaced parallel relationship, and the means defining the first and second printing positions are disposed in side by side relationship in their respective feed paths so that they lie in the path of movement of the printing device. There is a third position disposed in spaced relationship to the second position in the perpendicular direction of movement of the printing device, at which ink jet printing head maintenance is performed, and to which the printing device is moved periodically after a selected number of printing operation has taken place.

A microprocessor control means includes means for maintaining the printing device at either of the printing positions while a predetermined number of successive printing operations are performed by the printing device, and also include means to move the printing device to the third position when the predetermined number of printing operations at either of the printing positions is completed.

Having briefly described the general nature of the present invention, it is a principal object thereof to provide a mailing machine which prints postage indicia either on envelopes being fed through the mailing machine or on tape stored in the mailing machine while the envelopes and the tape follow distinct paths of travel.

It is another object of the present invention to provide a mailing machine in which a printing device moves laterally with respect to the direction of feed of envelopes through the mailing machine so as to print a postage indicia on envelopes or on the tape while the envelopes and the tape moves in separate paths of travel through the mailing machine.

It is a still further object of the present invention to provide a mailing machine in which a printing device moves from one of two separate printing positions to a maintenance position at the end of one or a predetermined number of printing operations for appropriate maintenance of the printing device.

These and other objects and advantages of the present invention will be more apparent from an understanding of the following detailed description of a presently preferred embodiment of the invention when considered in conjunction with the accompanying drawings.

DETAILED DESCRIPTION OF THE INVENTION

Figure 2:
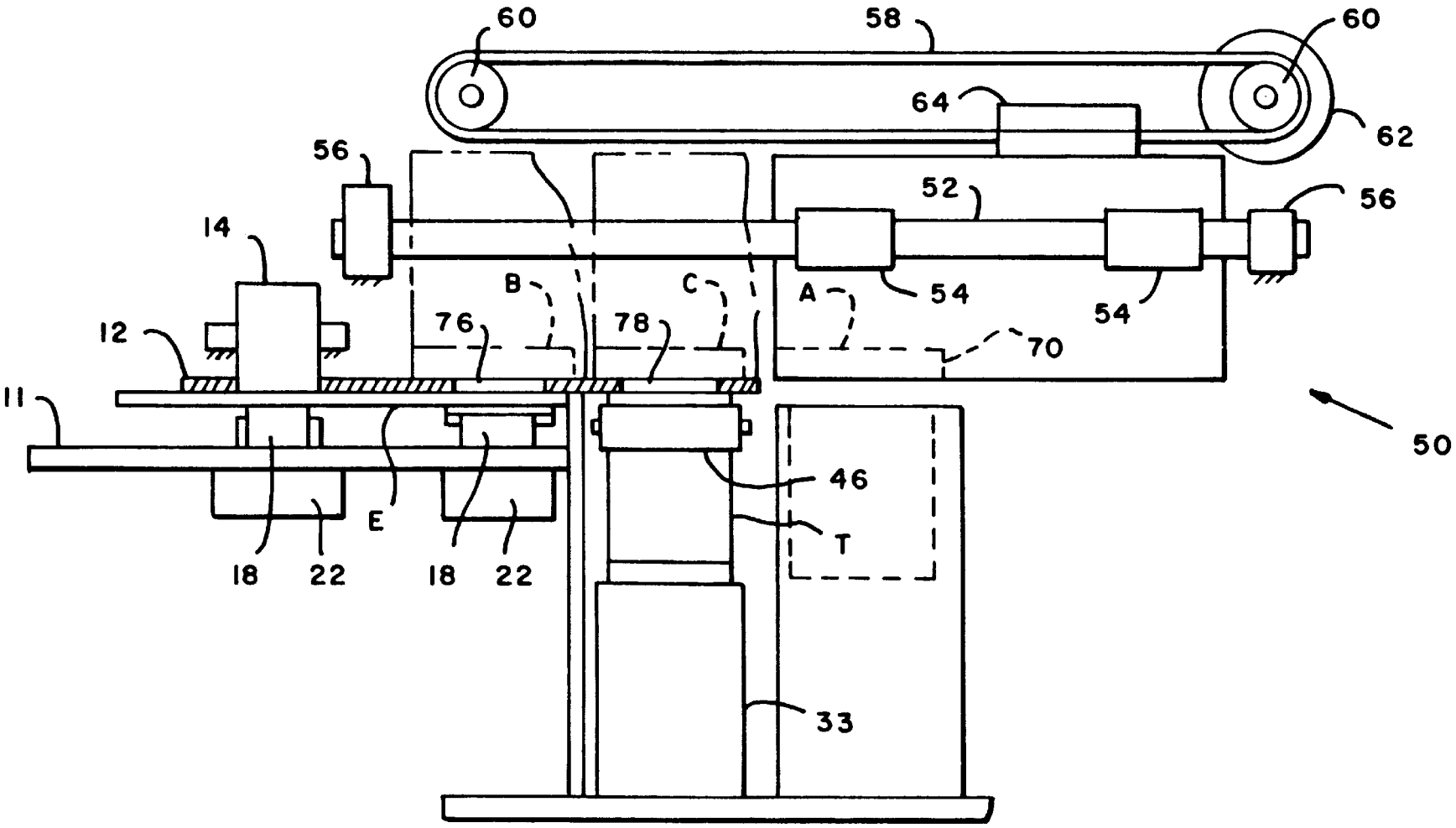
FIG. 2 is a side view of the mailing machine shown in FIG. 1.
Figure 3:
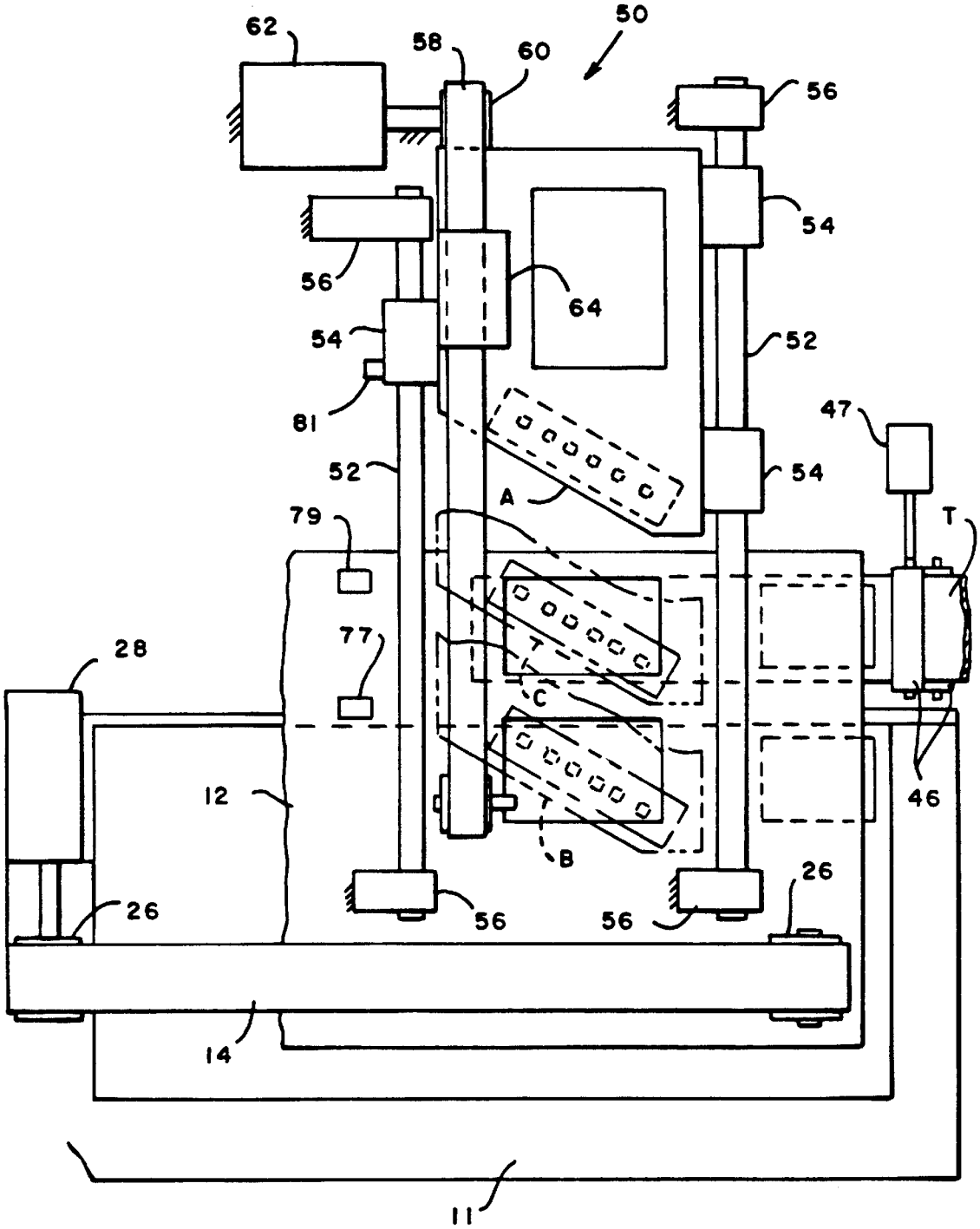
FIG. 3 is a plan view of the mailing machine shown in FIG. 1.

Referring now to the drawings, a representative mailing machine embodying the principles of the present invention is indicated generally by the reference numeral 10, and comprises a frame 11 which suitably supports all of the components of the mailing machine, including an elongate guide plate 12 which extends through the mailing machine 10, the underside of which defines a printing plane for the upper surface of envelopes E, and in conjunction with an endless belt 14, a feed path along which the envelopes are fed. The envelopes E are fed along the feed path by the lower run of the belt 14 which projects through an elongate slot 16 in the guide plate 12 so as to cooperate with a plurality of back up rollers 18. The rollers 18 are rotatably mounted on the free ends of arms 20 which are pivotally connected to a suitable housing 22 which is part of the frame 11, and are urged upwardly against the envelope E by suitable biasing means such as the springs 24. The belt 14 is supported by a pair of rollers 26, one of which is driven by a motor 28, as seen in FIG. 3. As best seen in FIG. 2, there are two rows of back up rollers 18 so as to ensure that the envelope E is adequately supported and maintained flat against the underside of the guide plate 12 for a purpose that will be made clear hereinbelow.

A tape T of indefinite length is suitably stored in the mailing machine 10 on a roll 32 mounted in a housing 33 and is fed upwardly from the roll 32 by a pair of feed rollers 34 and 36, the roller 36 also serving to feed the tape T into a throat 38 defined by the underside of the guide plate 12 and the upper surface of a pressure plate 40 which is movably mounted to press the tape T against the underside of the guide plate 12 in response to a spring 42 captured between the pressure plate 40 and a suitable housing 44 formed in the frame 11. Another pair of feed rollers 46 draws the tape T through the mailing machine 10 and feeds individual lengths of tape to a retrieval location after they have been printed and severed from the strip. The feed roller pair 34 and 36 and the feed rollers 46 are suitably driven by a motor 47 suitably connected to both pairs of feed rollers. As seen in FIGS. 2 and 3, the location of the tape T and the path of movement thereof, as defined by the location of the pair of feed rollers 34 and 36, the pressure plate 40 and the feed rollers 46, is disposed in offset parallel relationship to the feed path for the envelope 12, so that the respective feed paths are separate from one another. It should be understood that the principles of the present invention are applicable to mailing machines which have the capability of weighing mail pieces while they are being transported through the mailing machines, so that appropriate postage can be selected in the postage meter component of such mailing machines for printing on each individual mail piece. In machines of this type, the entire envelope feed mechanism, including the guide plate 12, the belt 14, the rollers 26, the backup rollers 18 and the supporting structure therefor, and the housing 22 would all be mounted as a unit on a load cell, in a manner well known in the art, so that the weight of an envelope being fed through the mailing machine could be detected by the load cell and transmitted to a postage meter, again in a manner known in the art.

The mailing machine 10 includes a printing device, indicated generally by the reference numeral 50. As best seen in FIG. 3. the printing device 50 is mounted on a pair of spaced apart parallel rails 52 by means of suitable sliding brackets 54, the rails 52 being supported by fixed brackets 56 mounted on the frame 11 and extending in a direction perpendicular to the direction of feed of envelopes E and the tape T through the mailing machine 10. The printing device 50 is moved back and forth along the rails 52 by an endless belt 58 supported on a pair of rollers 60, one of which is driven by a reversible motor 62. The printing device 50 is connected to the belt 58 by a suitable bracket 64.

In the preferred embodiment of the invention, the printing device 50 is an ink jet print head such as any of those mentioned above. These printers are well known in the art, and a detailed description thereof is not necessary to an understanding of the present invention, other than to note that the printing device 50 includes a nozzle plate 70 having an array of very small nozzles 72 through which small droplets of ink are ejected in a predetermined pattern under the control of suitable software so as to create a desired image on a receiving medium moving past the printer 50. It should be noted that the array of nozzles 72 is disposed at an angle to the direction of movement of envelopes E or the tape T along their respective feed paths. This is done so that the printing device 50 will print a more dense image than would be obtained if the array of nozzles were disposed perpendicular to the direction of movement of the envelopes or tape. Because of the physical size of the internal structure that causes ink to be expelled from the nozzles 72, they may not be spaced sufficiently close together to produce a clear, dense image when arranged perpendicular to the direction of movement of the envelopes or tape, and by disposing them at an angle to this direction of movement and energizing the ink ejecting devices in an appropriate sequence, the effect on the printed indicia is the same as if the nozzles are spaced more closely together.

It will be seen from FIGS. 2 and 3 that the printer 50 is movable between three different positions. In the position of the printer shown in solid lines in FIG. 3 and labeled A, the printer 50 is in what is referred to as a maintenance position, in which the nozzle plate 70 is engaged by a cleaning device and, at least for liquid ink systems, some form of enclosure that maintains an atmosphere adjacent the nozzle plate 72 that has a high level of ink solvent. As is well known in the art of ink jet printing, the nozzle plate must be cleaned frequently to prevent ink from collecting thereon adjacent to the nozzles, either during or between printing operations, and possibly obstructing the passage of ink therethrough during a subsequent printing operation. Also, even a small speck of dust on the nozzle plate can interfere with proper operation of the device. And many ink jet printer maintenance devices include a small housing containing a piece of absorbent material which is periodically saturated with ink solvent to maintain the atmosphere immediately surrounding the nozzle plate at a high level of solvent to further inhibit ink from drying out in the nozzles during prolonged period of non-use of the printing device. In the representative mailing machine disclosed in connection with the present invention, the maintenance apparatus for the printing device 50 is indicated by the box indicated generally by the reference numeral 74, and is located generally beneath the nozzle plate 70 when the printing device 50 is in the position labeled A.

Still referring to FIGS. 2 and 3, it will be seen that there are two additional positions for the printing device 50 in which the nozzle plate 70 is disposed in the positions labeled B and C. A first position labeled B is a printing position in which the printing device 50 will print a postage indicia on the upper surface of an envelope E, the nozzles 72 on the nozzle plate 70 having access to the upper surface of the envelope through a suitable slit aperture 76 formed in the guide plate 12. A second position labeled C is also a printing position in which the printing device 50 will print a postage indicia on the upper surface of the the tape T through another suitable aperture 78 formed in the guide plate 12. Suitable sensors, such as the Hall sensors 77 and 79 (see FIG. 3), are mounted adjacent to one of the rails 52 at the first and second printing positions so as to be actuated by a magnet 81 mounted on one of the brackets 54, to ensure that the printing device 50 stops with the nozzle plate 70 at a precise location with respect to the printing positions to prevent any possible loss of funds. Alternatively, microprocessor controlled stepper motors can be utilized to accurately control the movement of the printing device to cause it to stop at a predetermined printing position.

Figure 4:
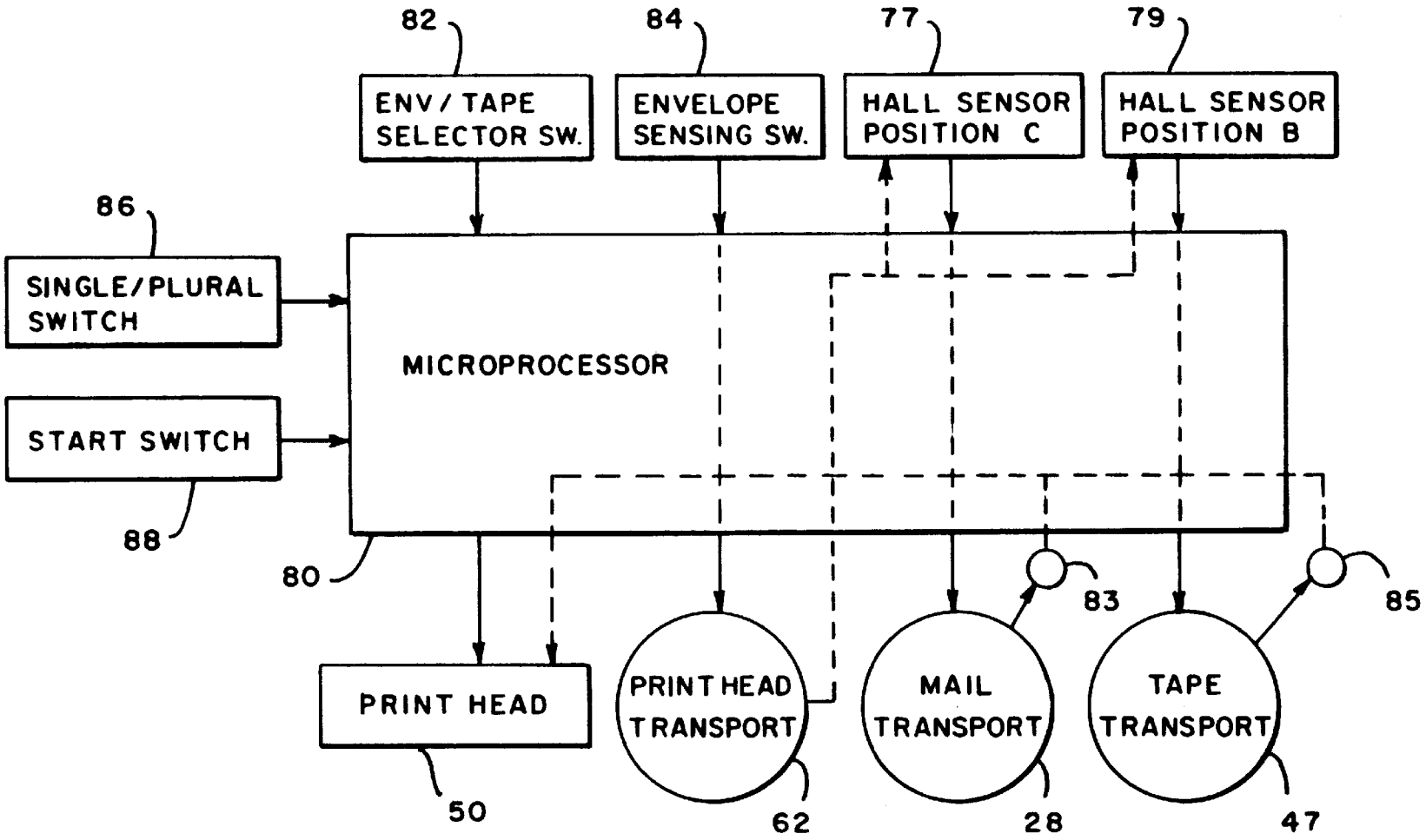
FIG. 4 is a schematic diagram of the principal elements of control for the mailing machine of the of the present invention.

FIG. 4 illustrates a representative simplified form of electrical and electronic control system for the mailing machine 10 described above. A microprocessor 80 is provided which controls the principal operational features of the mailing machine 10. Any suitable form of envelope/tape selector switch 82 is provided on a control panel for the mailing machine and functions to set the microprocessor 80 in an envelope or tape printing mode. A suitable sensor switch 84 is mounted in the path of an incoming envelope and functions to cause the microprocessor 80 to commence a cycle of operation of the mailing machine as fully described below.

Figure 1:
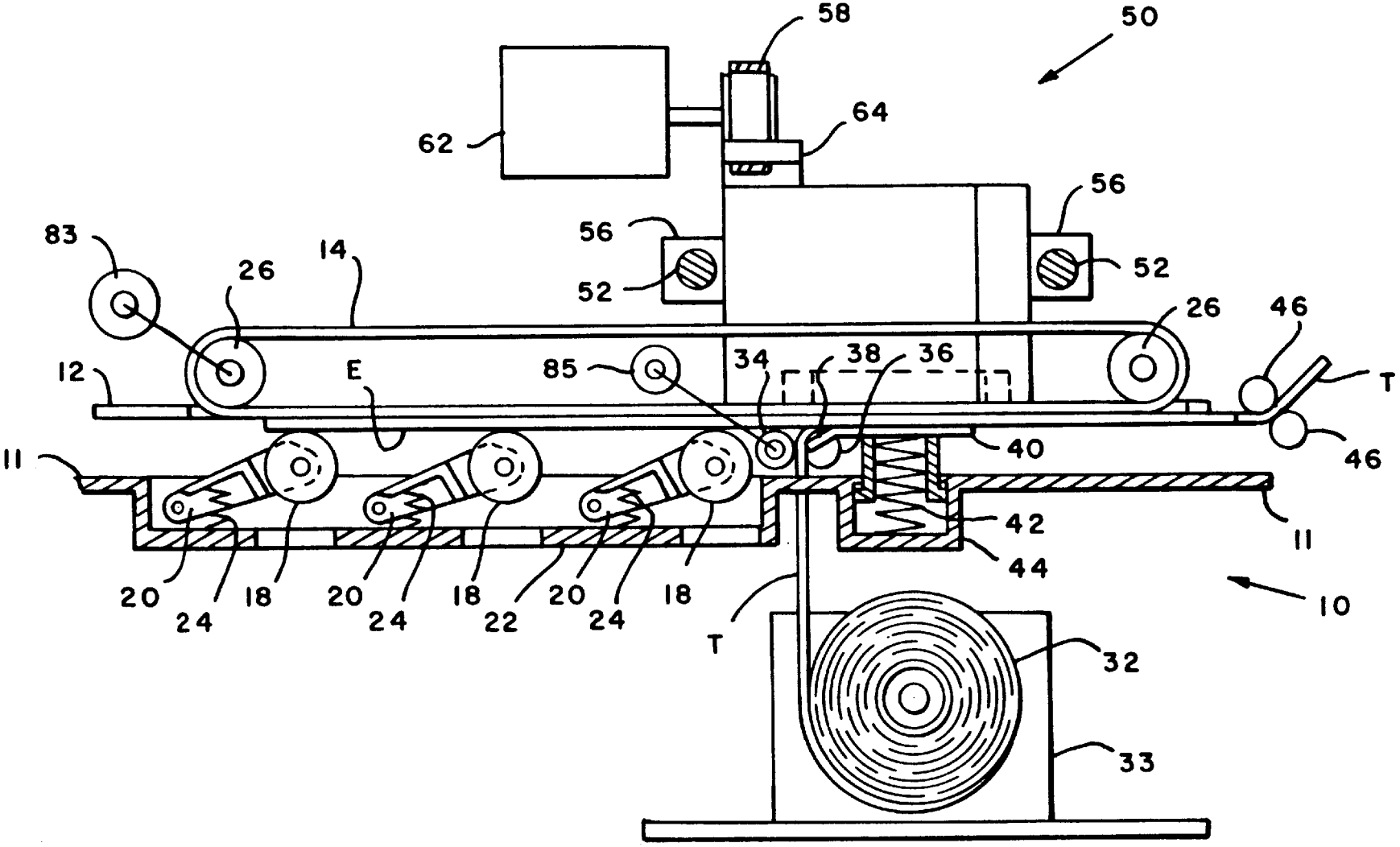
FIG. 1 is a front elevation of a representative mailing machine embodying the principles of the present invention.

The mailing machine 10 operates substantially in the following manner. If the user wishes to print a postage indicia directly on envelopes, he activates the envelope/tape control switch 82 to select the envelope printing mode. When an envelope is inserted into the mailing machine, either manually or by an automatic feeding device, it contacts the sensing switch 84 which activates the microprocessor 80 to energize the motor 62 to move the printing device 50 from the maintenance position A to the first printing position B so that it will print the postage indicia directly on the envelope. When the printing device 50 reaches the printing position B, as determined by the Hall sensor 77, the microprocessor then energizes the motor 28 to move the belt 14 to feed the envelope E in a direction from left to right as viewed in FIG. 1, during which a suitable position monitoring device, such as the optical encoder 83 coupled to the drive motor 28 for the belt 14, monitors the movement of the envelope E along the feed path. When the encoder 83 determines that the envelope E is in the proper position to receive the postage indicia, the microprocessor causes the printing device 50 to commence the printing operation, and the encoder 83, through the microprocessor, controls the operation of the ink ejection devices in the printing device 50 for each of the nozzles 72 to ensure the printing of a high quality postage indicia, all as is well known in the art. When the indicia is fully printed, the microprocessor terminates operation of the printing device 50 and the belt 14 ejects the envelope from the mailing machine. If no further envelopes are to be printed, the microprocessor again energizes the motor 62 to cause the printing device 50 to return to the maintenance position A.

If, on the other hand, successive envelopes are fed into the mailing machine 10, either manually or by means of an automatic feeder, the above cycle simply repeats for each successive envelope, at the end of which the microprocessor energizes the motor 62 to return the printing device 50 to the maintenance position A. It should be understood, however, that the microprocessor can be set to stop the operation of the feed belt 14 after any predetermined number of printing operations, and to cause the printing device 50 to return momentarily to the maintenance position A to permit the nozzle plate 70 to be cleaned.

If the user has an envelope which, for one reason or another, cannot be fed through the mailing machine 10, he again presses the envelope/tape selector switch 82 to select the tape printing mode, and also activates the single/multiple printing switch 86 to select between a single printing operation or some plurality thereof. He then presses the start button 88,which causes the microprocessor to energize the motor 62 to move the printing device 50 to the printing position B. When the printing device 50 reaches this position, as determined by the Hall sensor 79, the microprocessor activates the motor 47 to drive the feed rollers 34 and 36, and the feed roller 46 so as to move a section of the tape T beneath the printing device 50, during which another encoder 85, connected to the drive roller 34 of the tape drive monitors the movement of the tape T along its feed path. When the encoder 85 determines that a prescribed section of tape T is in the proper position to receive the postage indicia, the microprocessor 80 causes the printing device 50 to cycle through a printing operation in the same manner as that described above for printing the postage indicia on an envelope, with the encoder 85, through the microprocessor, controlling the operation of the ink ejection devices to ensure the printing of a high quality postage endicia, again the same as described above for printing on an envelope. When the printing operation is complete, the microprocessor 80 terminates operation of the printing device, activates an appropriate severing device (not shown since it is not part of the present invention) and causes the rollers 46 to eject the severed strip of tape from the mailing machine. The microprocessor then activates the motor 62 to return the printing device 50 to the maintenance position A, unless the operator has activated the single/multiple switch 86 to select the multiple print mode, in which case the microprocessor will permit the printing device 50 to repeat the printing operation a predetermined number of times before it is automatically returned to the maintenance position A.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

I claim:

1. A mailing machine for printing on first and second recording mediums passing therethrough, the mail machine comprising:

a first feed path, including a first feed path printing position, along which the first recording medium is fed to the first feed path printing position;

a second feed path including a second feed path printing position, along which the second recording medium is fed to the second feed path printing position;

a printing device mounted for movement between the first and second feed path printing positions; and means for moving the moving the printing device between the first and second feed path printing positions;

wherein at times when the printing device and the first recording medium are each at the first feed path printing position the printing device prints on the first recording medium, and when the printing device and the second recording medium are each at the second feed path printing position the printing device prints on the second recording medium.

2. A mailing machine as recited in claim 1, wherein the first recording medium is a tape and the second recording medium is a mailpiece.

3. A mailing machine as recited in claim 2, further comprising means for controlling movement of the printing device between the first and second feed path printing positions depending on whether the tape is being fed along the first feed path or the mailpiece is being fed along the second feed path.

4. A mailing machine as recited in claim 3, wherein the printing device prints a postage indicia.

5. A mailing machine as recited in claim 4, wherein the first and second feed paths are spaced closely adjacent to one another so that said first and second feed paths are disposed in adjacent closely spaced parallel relationship.

6. A mailing machine as recited in claim 5, wherein the first and second feed path printing positions are spaced in relative side by side relationship so that they lie in a path of movement of said printing device.

7. A mailing machine as recited in claim 6, wherein the path of movement is in a direction that is perpendicular to a direction of the first and second feed paths.

8. A mailing machine as recited in claim 7, further including a maintenance position disposed in spaced relationship to the first and second feed path printing positions and in the path of movement of the printing device, wherein the printing device is moved to the maintenance position after a selected number of printings of the postage indicia has occurred.

9. A mailing machine as recited in claim 8, wherein the printing device is an ink jet printer having nozzles therein through which ink is ejected, and said maintenance position includes a maintenance device which services the ink jet nozzles.

10. A mailing machine as recited in claim 9, wherein the controlling means includes means for maintaining the printing device at either of the first and second feed path printing positions while a predetermined number of successive printing operations are performed by the printing device.

11. A mailing machine as recited in claim 10, wherein the controlling means further includes means operative to move the printing device to the maintenance position when the predetermined number of printing operations is completed.

12. A method for printing on first and second recording mediums passing through a mailing machine, the method comprising the steps of:

selectively feeding the first recording medium along a first feed path to a first printing station;

selectively feeding the second recording medium along a second feed path to a second printing station;

moving a printing device to the first printing station when the first recording medium is fed to the first printing station, the printing device printing on the first recording medium at the first printing station; and moving the printing device to the second printing station when the second recording medium is fed to the second printing station, the printing device printing on the second recording medium at the second printing station.

13. A method as recited in claim 12, wherein the first recording medium is a tape and the second recording medium is a mailpiece.

14. A method as recited in claim 13, wherein the printing device prints an indicia.

* * * * *